US011197102B2

(12) United States Patent
Scheek et al.

(10) Patent No.: US 11,197,102 B2
(45) Date of Patent: Dec. 7, 2021

(54) DISTRIBUTED TRANSDUCER SUSPENSION CONES (DTSC)

(71) Applicant: Mayht Holding B.V., Nieuw-Vennep (NL)

(72) Inventors: Timothy Ruben Scheek, Rotterdam (NL); Mattias Jeffrey Scheek, Amsterdam (NL)

(73) Assignee: Mayht Holding B.V., Nieuw-Vennep (NL)

( * ) Notice: Subject to any disclaimer, the term of this patent is extended or adjusted under 35 U.S.C. 154(b) by 0 days.

(21) Appl. No.: 16/769,596

(22) PCT Filed: Apr. 24, 2018

(86) PCT No.: PCT/NL2018/050263
§ 371 (c)(1),
(2) Date: Jun. 4, 2020

(87) PCT Pub. No.: WO2019/117706
PCT Pub. Date: Jun. 20, 2019

(65) Prior Publication Data

US 2020/0344554 A1 Oct. 29, 2020

(30) Foreign Application Priority Data

Dec. 11, 2017 (WO) ..... PCT/NL2017/050830

(51) Int. Cl.
*H04R 9/06* (2006.01)
*H04R 7/18* (2006.01)
(Continued)

(52) U.S. Cl.
CPC ..... *H04R 9/063* (2013.01); *H04R 7/18* (2013.01); *H04R 7/26* (2013.01); *H04R 9/025* (2013.01);
(Continued)

(58) Field of Classification Search
CPC . H04R 9/063; H04R 7/18; H04R 7/26; H04R 9/025; H04R 9/043; H04R 2400/11
See application file for complete search history.

(56) References Cited

U.S. PATENT DOCUMENTS 4,191,863 A * 3/1980 Matsuda ..... H04R 9/063 381/182
2003/0048920 A1* 3/2003 Van Halteren ..... H04R 9/063 381/424

(Continued)

FOREIGN PATENT DOCUMENTS

WO 03/101149 A1 12/2003

*Primary Examiner* — Sunita Joshi
(74) *Attorney, Agent, or Firm* — N.V. Nederlandsch Octrooibureau; Catherine A. Schultz; Katelyn J. Bernier

(57) ABSTRACT

A speaker device (1) having a frame (2), two opposite directed diaphragms (3, 3'), and two speaker drivers, each having at least one magnetic driver (10, 10') for driving the two opposite directed diaphragms (3, 3') in operation. A speaker damper (5, 5') is associated with each of the two opposite directed diaphragms (3, 3'), and has a coil bracket (4, 4') arranged to be driven by the associated at least one magnetic driver (10, 10'), a diaphragm connection member (6, 6') arranged to fixedly attach the diaphragm (3, 3') to the speaker damper (5, 5'), and a damper frame connection member (8, 8') arranged to fixate the speaker damper (5, 5') to the frame (2). The speaker damper (5, 5') further comprises a damper leg member (7, 7') arranged between the diaphragm connection member (6, 6') and the damper frame connection member (8, 8').

11 Claims, 4 Drawing Sheets

(51) Int. Cl.
*H04R 7/26* (2006.01)
*H04R 9/02* (2006.01)
*H04R 9/04* (2006.01)

(52) U.S. Cl.
CPC ..... *H04R 9/043* (2013.01); *H04R 2400/11* (2013.01)

(56) References Cited

U.S. PATENT DOCUMENTS

| | | | | |
|---|---|---|---|---|
| 2010/0172535 | A1 | 7/2010 | Huang | |
| 2011/0075880 | A1* | 3/2011 | Kamimura ..... | H04R 9/10 381/413 |

* cited by examiner

DISTRIBUTED TRANSDUCER SUSPENSION CONES (DTSC)

FIELD OF THE INVENTION

The present invention relates to the field of speakers. More specifically, the present invention relates to a speaker device comprising a frame, two opposite directed diaphragms, and two speaker drivers.

BACKGROUND ART

Speakers are e.g. known from U.S. Pat. Nos. 6,853,734 B2, 7,366,318 B2 and 8,311,263 B2.

SUMMARY OF THE INVENTION

The present invention seeks to provide a speaker device with as small as possible external dimensions, yet with high performance and linearity.

According to the present invention, a speaker device as defined above is provided, in which each speaker driver has at least one magnetic driver for driving the two opposite directed diaphragms in operation. The speaker device further comprises a speaker damper associated with each of the two opposite directed diaphragms, the speaker damper comprising a coil bracket arranged to be driven by the associated at least one magnetic driver, a diaphragm connection member arranged to fixedly attach the diaphragm to the speaker damper, and a damper frame connection member arranged to fixate the speaker damper to the frame. The speaker damper further comprises a damper leg member arranged between the diaphragm connection member and the damper frame connection member.

SHORT DESCRIPTION OF DRAWINGS

The present invention will be discussed in more detail below, with reference to the attached drawings, in which FIGS. 1A and B show a perspective view and a cross sectional view, respectively, of a dual cone speaker device;

DESCRIPTION OF EMBODIMENTS

Figure 1A:
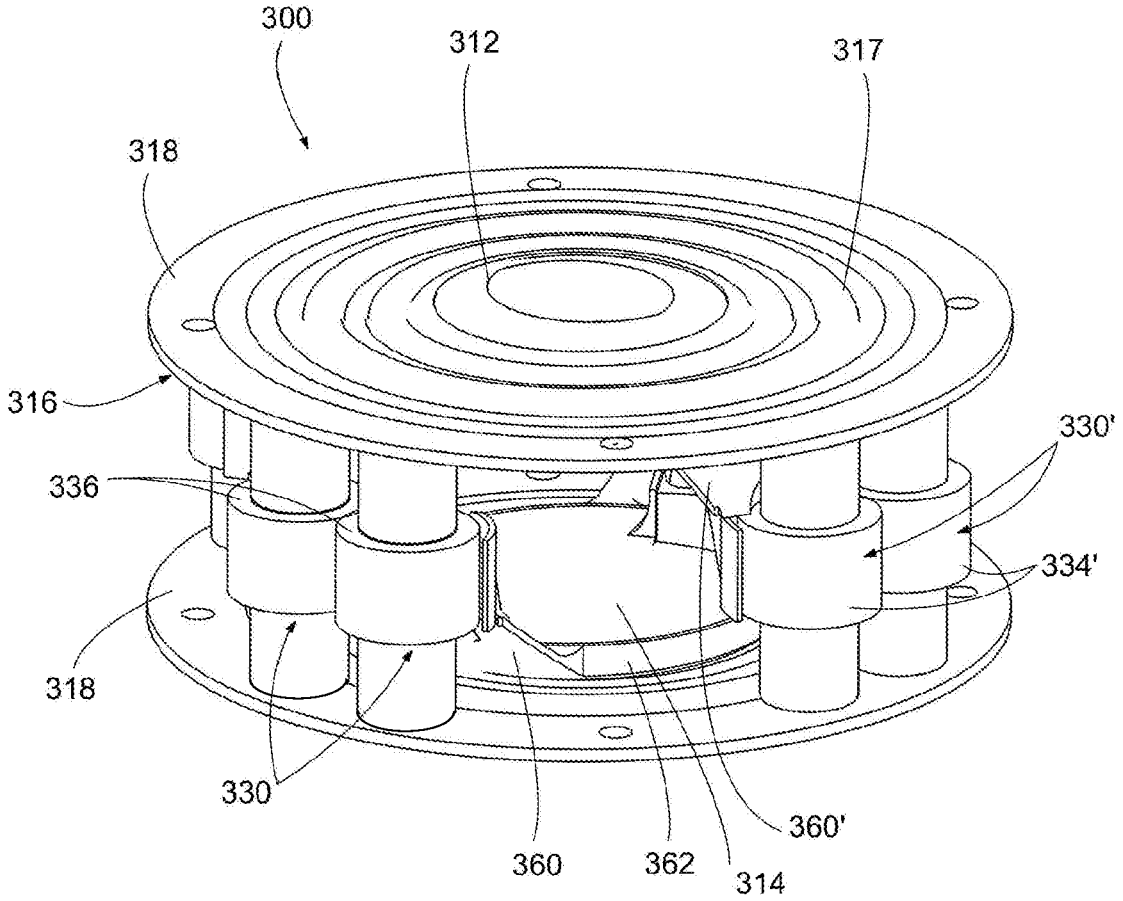

The invention will be explained in detail with reference to some drawings that are only intended to show embodiments of the invention and not to limit the scope. The scope of the invention is defined in the annexed claims and by its technical equivalents. I.e., a person skilled in the art will understand that features, components, elements, etc. explicitly used to explain the invention can be substituted by technical equivalents unless otherwise stated. Moreover, separate features of different embodiments can be combined, even if not explicitly shown in the drawings or explained in the specification, unless such combination is physically impossible.

The present invention will be discussed in more detail below, with reference to some drawings.

The examples and embodiments described herein serve to illustrate rather than to limit the invention. The person skilled in the art will be able to design alternative embodiments without departing from the scope of the claims. Reference signs placed in parentheses in the claims shall not be interpreted to limit the scope of the claims. Items described as separate entities in the claims or the description may be implemented as a single or multiple hardware items combining the features of the items described.

It is to be understood that the invention is limited by the annexed claims and its technical equivalents only. In this document and in its claims, the verb "to comprise" and its conjugations are used in their non-limiting sense to mean that items following the word are included, without excluding items not specifically mentioned. In addition, reference to an element by the indefinite article "a" or "an" does not exclude the possibility that more than one of the element is present, unless the context clearly requires that there be one and only one of the elements. The indefinite article "a" or "an" thus usually means "at least one".

In a speaker that uses the dual opposing driver principle in the classic sense, drivers are placed in a back-to-back position.

The benefit of this architecture is that the opposing drivers cancel out mechanical vibrations of the enclosure. Because of this cancellation, the enclosure is effected significantly less by the movement of the drivers, even if the enclosure is relatively light, of low rigidity and or small in relation to the drivers. The downside is that the footprint is bound by at least two times the depth of the identical drivers.

Converging the drivers is a method for decreasing the minimum amount of volume needed in the speaker design, as for example described in the not yet published patent application NL1042617 of the present applicant, which is incorporated herein by reference. In the situation that the opposing drivers are converged and the magnet motors are placed in the same plane, the second suspension or damper of the electrodynamic loudspeaker (the 'spider') does not fit in between the two transducers because of the resting position of the opposing drivers, and because of the physical constrictions at inward excursion, the spiders of the opposing drivers would intersect. The spider is a necessary part for linear excursion, and linear excursion is necessary for quality sound reproduction. Because the opposing diaphragms meet in the center of the speaker at maximum sound pressure level, the suspension cannot be in line with the diaphragms of the two opposing drivers because they would collide.

Figure 1B:
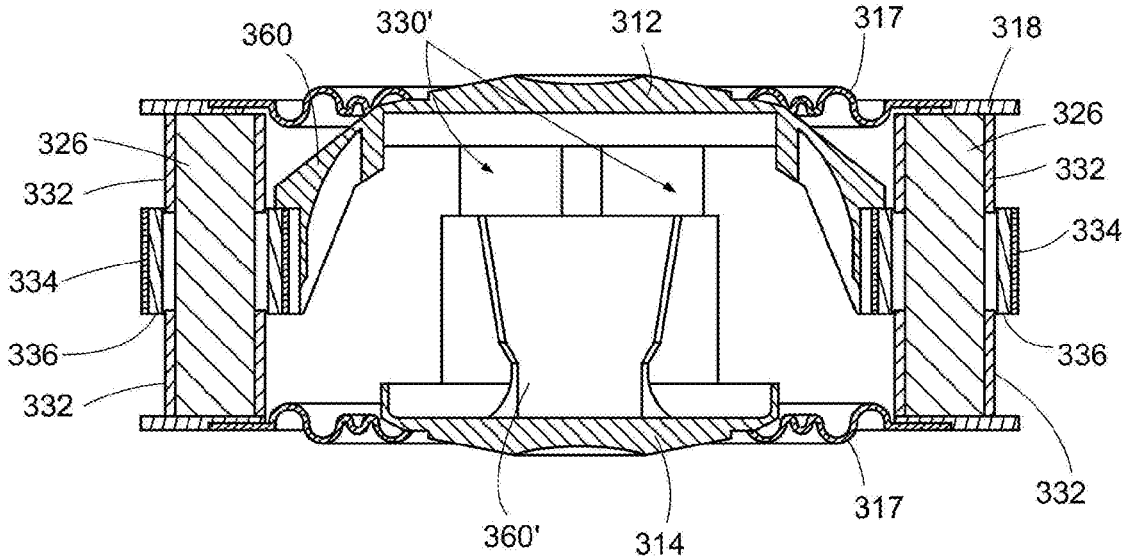

In FIGS. 1A and 1B (which is a copy of FIGS. 4A and 4B of the not yet published patent application mentioned above, there is shown a perspective view and a cross sectional view of a loudspeaker device 300. The brackets 360, 360' of the loudspeaker device 300 are formed integral with a collar 362, 362' which are attached to the diaphragms 312, 314, respectively. In the embodiment as illustrated, the brackets 360, 360' are formed integrally with the diaphragms 312, 314.

The motors 330, 330' of the loudspeaker device 300 are arranged in pairs, with the formers 336 of each pair of motors 330, 330' being connected to one of the brackets 360, 360'. The pairs of motors 330, 330' are arranged in an alternating manner around the frame 316. As shown there are two pairs of motors 330, 330' for each diaphragm 312, 314, respectively. Arranging the motors 330, 330' in pairs which shares a common bracket 360, 360' may increase the efficiency with which the diaphragms 312, 314 are moved and may also reduce the mass of the brackets 360, 360' compared to arrangements where the four motors of each diaphragm are equally spared around the diaphragm and thus required four brackets.

The loudspeaker device 300, as shown, uses motors 330, 330' with multiple magnets 332, 332'. Each motor 330, 330' comprises two magnets 332, 332' arranged to increase the excursion of the voice coils 334, 334' and thus the diaphragms 312, 314.

Figure 2:
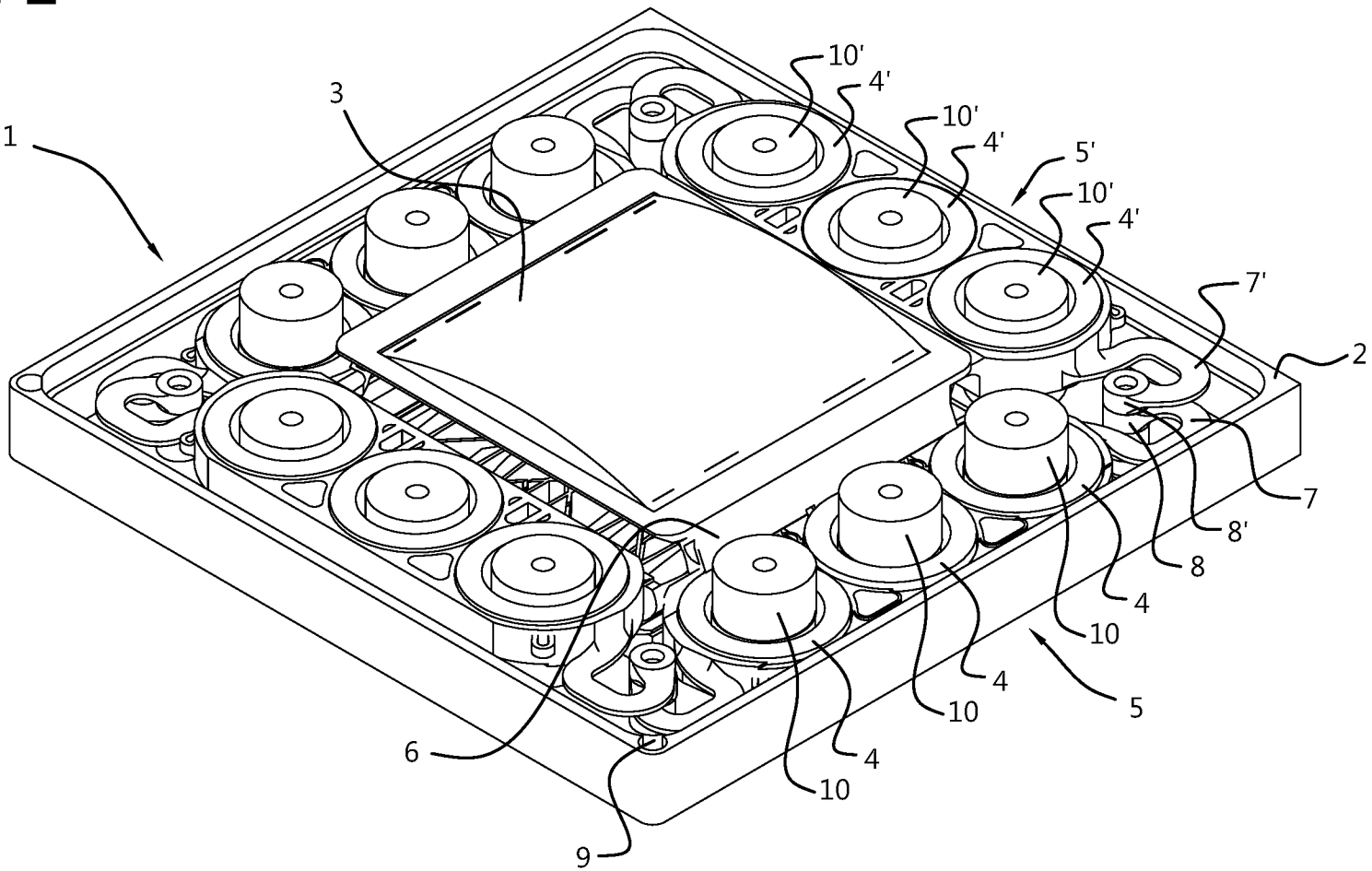
FIG. 2 shows a perspective view of an embodiment of a speaker device according to an embodiment of the present invention.

The present invention relates to a speaker device of a type with Distributed Transducer Suspension Cones, DTSC, an exemplary embodiment thereof being shown in the perspective view of FIG. 2. The speaker device 1 comprises a frame 2 and two opposing diaphragms 3 (only one visible in FIG. 2). A speaker damper 5 comprises a plurality of coil brackets 4, which are in operation connected to the moving coil part of a speaker driver 10 (similar to the motors 330, 330' described above). In the exemplary embodiment shown, for each diaphragm 3, two speaker dampers 5 are present, each having three coil brackets 4. It is noted that different numbers of speaker dampers 5 and coil brackets 4 per diaphragm may be implemented, see also the alternative exemplary embodiments described below. In generic wording, in a group of embodiments the number of coil brackets 4 of each speaker damper 5, 5 is at least two. In a further group of embodiments, a speaker damper 5 is present on two opposite sides of each of the two opposite directed diaphragms 3.

The diaphragm 3 is connected to the speaker damper 5 via a diaphragm connection member 6 (only one visible in FIG. 2, but provided at two opposing sides of the diaphragm 3). Furthermore, the speaker damper 5 comprises a damper frame connection member 8 at both ends of the speaker damper 5, for connecting the speaker damper 5 to a frame connection element 9, which is part of the frame 2, and e.g. implemented as a pin as shown in the embodiment of FIG. 2. Furthermore, the speaker damper 5 comprises a damper leg member 7 positioned between the coil brackets 4 and the damper frame connection member 8.

In generic wording, according to the present invention, a speaker device is provided in various embodiments, the speaker device 1 comprising a frame 2, two opposite directed diaphragms 3, 3', and two speaker drivers each having at least one magnetic driver 10, 10' for driving the two opposite directed diaphragms 3, 3' in operation. The speaker device 1 further comprises a speaker damper 5, 5' associated with each of the two opposite directed diaphragms 3, 3', the speaker damper 5, 5' comprising a coil bracket 4, 4' arranged to be driven by the associated at least one magnetic driver 10, 10', a diaphragm connection member 6, 6' arranged to fixedly attach the diaphragm 3, 3' to the speaker damper 5, 5', and a damper frame connection member 8, 8' arranged to fixate the speaker damper 5, 5' to the frame 2. The speaker damper 5, 5' further comprises a damper leg member 7, 7' arranged between the diaphragm connection member 6, 6' and the damper frame connection member 8, 8'.

The construction of the present invention embodiments of a speaker device provides for a speaker device 1 with a linearly compliant, flexible, resilient and flat speaker damper 5 connected between the frame 2 and the coil brackets 4 of the respective associated diaphragm 3, and makes it possible to have the 'spider' of both drivers/motors 10 to cross through the middle plane of the speaker device 1, without colliding. It is noted that like elements in the embodiments described herein with reference to the figures refer to similar or the same elements as denoted by the reference numerals.

Figure 3:
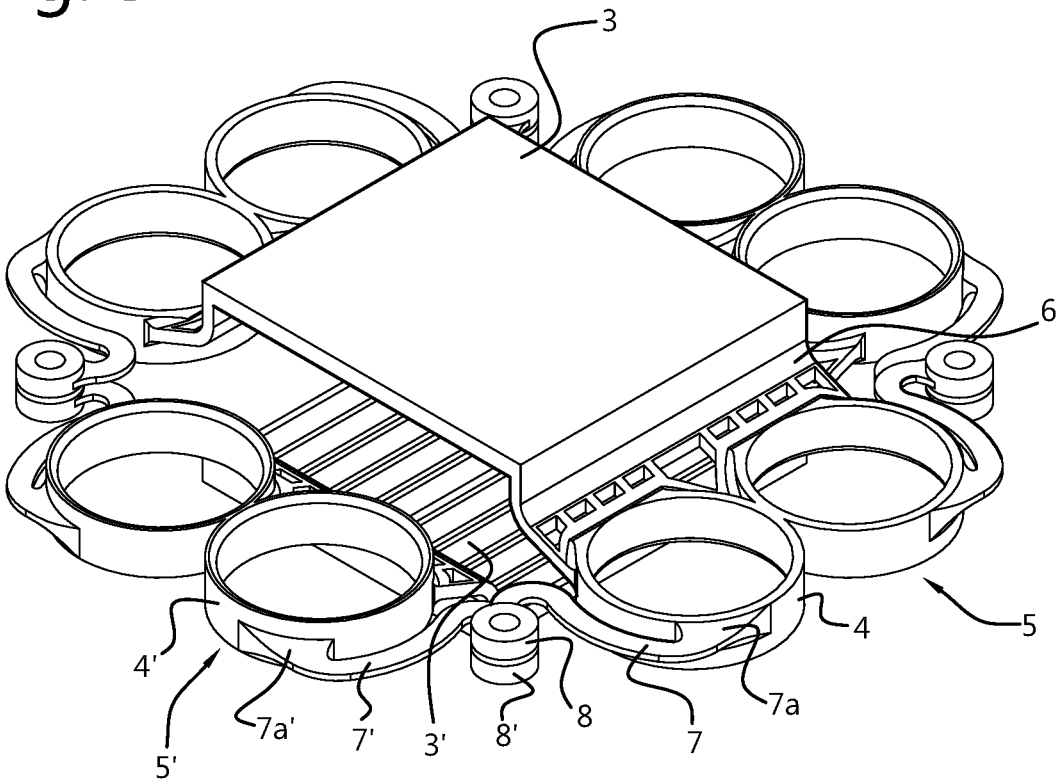
FIG. 3-5 show a perspective view, cross sectional view and detail view, respectively, of parts of a speaker device relevant for a further embodiment of the present invention.
Figure 4:
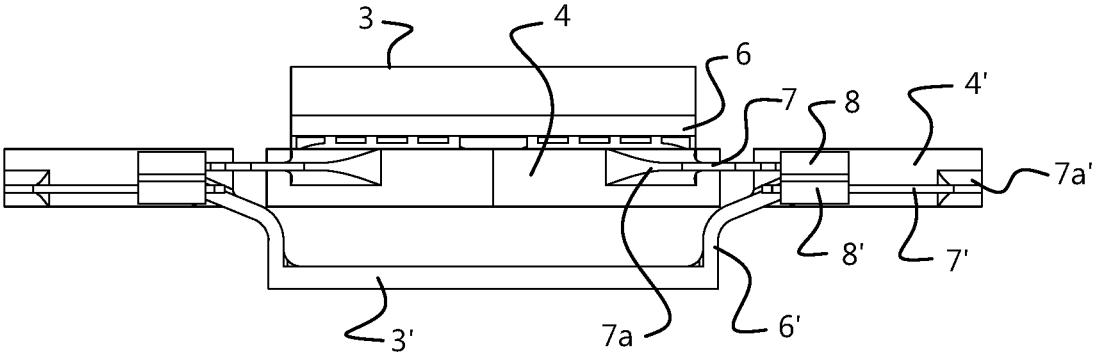
Figure 5:
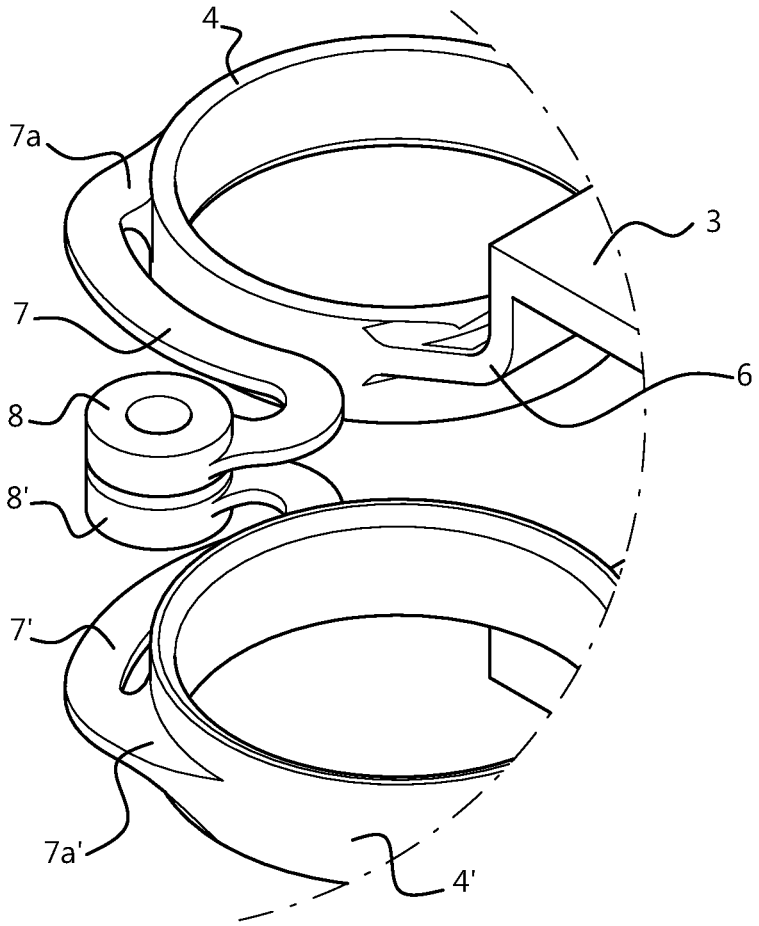

In a specific group of embodiments the construction is exploited by having the combination of diaphragm 3 and the speaker dampers 5 made as a single working piece, e.g. injection moulded. FIG. 3-5 show a further exemplary embodiment of the DTSC type of speaker device 1 according to the present invention. In these drawings, the frame 2 and motor/driver elements 10 of the speaker device 1 have been left out, to more clearly show the structural relationship and dimensions of the speaker damper 5 and directly associated components.

As shown in FIG. 3, this embodiment clearly shows the presence of the (opposing) diaphragms 3, 3'. The associated elements of the lower diaphragm 3' are indicated by primed reference numerals. It is clearly shown that a speaker damper 5 is provided on each side of the diaphragm 3, and in this example, each speaker damper 5 comprises two coil brackets 4. From the perspective view of FIG. 3, and from the cross sectional view of FIG. 4, it is clear that all elements forming the speaker damper 5 and its connections to the diaphragm 3 and the frame 2 are the same at each side of the diaphragm 3. Furthermore, for the opposing diaphragm 3', also the various elements are the same. In other words, the lower set of speaker dampers 5' and diaphragm 3' are the same as the upper set of speaker dampers 5 and diaphragm 3, but then upside down, and rotated over 90 degrees.

In all embodiments described herein, a further optional feature of the present invention embodiments is shown, i.e. that the speaker damper 5, 5' is mirror symmetric (with respect to a middle line of the associated diaphragm 3, 3'). This is advantageous in providing a proper linear response of the speaker device 1, and facilitates manufacturing of the speaker damper 5, 5'. As also shown in these embodiments, the two sets of speaker dampers 5, 5' can be attached to the frame 2, as the damper frame connection members 8, 8' are offset in the direction of diaphragm motion 9 e.g. by a distance of 3-4 mm). this allows to attach all sides of the speaker dampers 5, 5' at only four locations in the frame 2, yet to have all the speaker damper 5, 5' components positioned within the small height of the speaker device 1. Also it allows all elements of the speaker damper 5 which are moving during operation, to be positioned outside of the space between the opposing diaphragms 3, 3'.

FIG. 5 shows a detailed perspective view of a part of the speaker device 1 of FIG. 3, showing that the speaker damper 5 comprises a damper frame connection member 8 (e.g. a ring), a damper leg member 7 and a diaphragm connection member 6. The connection of damper leg member 7 to diaphragm connection member 6 is implemented using a leg attachment body 7*a*, which allows to transfer forces and movement appropriately. The form and material of damper leg member 7 is such that a resilient, linear behaviour in the up and down direction of diaphragm 3 is accomplished. In an embodiment, to this end, the damper leg member (7, 7') comprises a resilient material.

E.g. the damper leg member 7 may be implemented as a strip like element, wherein the width is larger than the thickness of the strip like element, or even as a flat strip. Furthermore, resilience may be improved by implementing the damper leg member 7 as a meandering strip [claim 5], i.e. with a pattern diverting from a straight line between damper frame connection member 8 and leg attachment body 7 (or coil bracket 4). In a specific exemplary embodiment, the damper leg member (7, 7') has a length which is greater than a shortest distance between the coil bracket (4, 4') and damper frame connection member (8, 8').

As a further example, the damper leg body 7 may have a tangential connection to the coil bracket 4, initially pointing outward, followed by a 90 degree left bent and a subsequent 135 degree left bent towards the damper frame connection member 8, as shown in the embodiment of FIG. 2, or alternatively, as shown in the embodiment of FIG. 3-5, the damper leg body 7 may have a tangential connection to the coil bracket 4, initially pointing inward, followed by a 180 degree bent towards the damper frame connection member 8. By having the interior space of the frame 2 of the speaker device 1 as a generally rectangular formed shape, the corner areas outside the coil brackets 4 can be used to position the (meandering) damper leg member 7. In other words, in a further embodiment, the damper leg member (7, 7') is positioned in a corner area of the frame (2).

As described above with reference to the embodiments shown in FIG. 2-5, instead of the spider being a single object in prior art speaker devices, the DTSC type of speaker devices have multiple separate suspension units (i.e. speaker dampers 5). Each separate suspension unit (speaker dampers 5) is placed in the same circumference area part in the frame 2 as the magnet structure of the speaker device 1, or out of the circumference of the (magnet) motor. In any case, the speaker dampers 5 are at least not directly behind the diaphragms 3, 3' of the two opposing drivers. It is noted that the speaker dampers 5 (or spider suspension units) can have many different geometries and materials, but the most important characteristics are:

- the speaker damper 5 (spider suspension unit) connects the diaphragm 3 (cone) at multiple places (i.e. via frame connection elements 9) to the frame 2 to avoid nonlinear movement,
- the speaker damper 5 components ('spider objects') move through the same plane when the drivers '(i.e. coil bracket 4 as described above) make an excursion towards each other from the resting position, and
- the speaker damper 5 components ('spider objects') are not directly behind the diaphragms 3, 3, but around the diaphragms.

Relevant features of further exemplary embodiments are:

There is a minimum of 2 suspension units (i.e. speaker damper 5) per driver/motor/coil, there is no maximum.

Because of the speaker damper 5 material and geometry the speaker dampers 5 are most flexible in the direction of the drivers/motors excursion, and prevents non-linear driver/motor excursion.

The speaker dampers 5 can be fixed to the diaphragm 3, coil or coil bracket 4 in a position between the top and the bottom of associated elements (i.e. directly to the diaphragm 3 or to the coil or coil bracket 4.

Because of the distributed (more specifically DCST) configuration. the speaker dampers 5 present in a speaker device 1 are never all connected to the same coil, coil bracket 4 or same position at the diaphragm 3.

The diaphragms 3, 3', in resting position, have a distance between them which is at least as big as two times the one-way driver excursion of a motor driver 10. In other words, the two opposite directed diaphragms 3, 3' are at a mutual distance at rest which is equal to twice the operational excursion distance of the at least one motor drivers 10, 10'. This ensures a high as possible amplitude of the diaphragms 3, 3' without any risk of the diaphragms 3, 3' or nearby components interfering with each other.

The two diaphragms 3, 3' are placed opposing each other, both fixed at the ends of the separate speaker dampers 5.

The separate speaker dampers 5 are next to the coil brackets 4, staying in the bounding box formed by the coil brackets 4. They could—for example—also be adjacent to the coil brackets 4 at the longer sides of the frame 2, i.e. not in the corner areas of the frame 2 (as shown in the exemplary embodiments described with reference to FIGS. 2-5. The only place the speaker dampers 5 are not allowed to be positioned is in between the diaphragms 3, 3'.

The geometry of the diaphragms 3, 3' (or cones) is made in a way that there is a distance in between the diaphragms 3, 3' which is at least equal to the maximum inward excursion of both diaphragms 3, 3' combined. E.g. if the top diaphragm 3 and bottom diaphragm 3' both separately have a zero-to-peak excursion of distance x, the distance between diaphragms 3, 3' is distance 2×.

The present invention has been described above with reference to a number of exemplary embodiments as shown in the drawings. Modifications and alternative implementations of some parts or elements are possible, and are included in the scope of protection as defined in the appended claims.

The invention claimed is:

1. A speaker device comprising a frame, two opposite directed diaphragms, and two speaker drivers, each having at least one magnetic driver for driving the two opposite directed diaphragms in operation, further comprising

- a speaker damper associated with each of the two opposite directed diaphragms,
- the speaker damper comprising a coil bracket arranged to be driven by the associated at least one magnetic driver, a diaphragm connection member arranged to fixedly attach the diaphragm to the speaker damper, and a damper frame connection member arranged to fixate the speaker damper to the frame,
- the speaker damper further comprising a damper leg member arranged between the diaphragm connection member and the damper frame connection member.

2. The speaker device according to claim 1, wherein the damper leg member comprises a resilient material.

3. The speaker device according to claim 1, wherein the damper leg member is a flat strip.

4. The speaker device according to claim 1, wherein the damper leg member has a length which is greater than a shortest distance between the coil bracket and damper frame connection member.

5. The speaker device according to claim 1, wherein the damper leg member is a meandering strip.

6. The speaker device according to claim 1, wherein the damper leg member is positioned in a corner area of the frame.

7. The speaker device according to claim 1, wherein the speaker damper is mirror symmetric.

8. The speaker device according to claim 1, wherein the number of coil brackets of each speaker damper is at least two.

9. The speaker device according to claim 1, wherein the two opposite directed diaphragms are at a mutual distance at rest which is equal to twice the operational excursion distance of the at least one motor drivers.

10. The speaker device according to claim 1, wherein a speaker damper is present on two opposite sides of each of the two opposite directed diaphragms.

11. The speaker device according to claim 10, wherein the combination of diaphragm and the speaker damper is a single working piece.

* * * * *